United States Patent [19]

Mitchell

[11] Patent Number: 5,035,538

[45] Date of Patent: Jul. 30, 1991

[54] ARCUATE PRECAST TUNNEL LINING SEGMENTS

[75] Inventor: Samuel B. H. Mitchell, Staines, United Kingdom

[73] Assignee: Costain Building Products Limited, Kirkby-In-Ashfield, England

[21] Appl. No.: 490,440

[22] Filed: Mar. 8, 1990

[30] Foreign Application Priority Data

Mar. 8, 1989 [GB] United Kingdom ..... 8905319

[51] Int. Cl.[5] ..... E21D 11/00

[52] U.S. Cl. ..... 405/151; 405/150; 405/152; 405/153

[58] Field of Search ..... 405/150–153; 52/224, 245, 249, 584, 704, 707; 411/82, 108, 338, 339, 546

[56] References Cited

U.S. PATENT DOCUMENTS

| | | | |
|---|---|---|---|
| 1,779,275 | 10/1930 | Humphryes | 405/153 |
| 3,483,706 | 12/1969 | Taradash et al. | 405/152 |
| 4,182,092 | 1/1980 | Weaver | 52/707 X |
| 4,477,204 | 10/1984 | Rohde et al. | 405/153 |
| 4,594,026 | 6/1986 | Hauer et al. | 405/153 |
| 4,934,887 | 6/1990 | Sharp et al. | 411/339 |

FOREIGN PATENT DOCUMENTS

| | | | |
|---|---|---|---|
| 906083 | 3/1954 | Fed. Rep. of Germany | 405/152 |
| 1534628 | 3/1970 | Fed. Rep. of Germany | 405/152 |
| 2139268 | 1/1976 | United Kingdom . | |
| 1512781 | 6/1978 | United Kingdom . | |
| 1520181 | 8/1978 | United Kingdom . | |
| 2139278 | 7/1980 | United Kingdom . | |
| 2004931 | 5/1982 | United Kingdom . | |
| 2126630 | 3/1984 | United Kingdom . | |
| 2149833 | 6/1985 | United Kingdom . | |
| 2152099 | 7/1985 | United Kingdom . | |
| 2131514 | 2/1986 | United Kingdom . | |
| 2139277 | 2/1987 | United Kingdom . | |

*Primary Examiner*—Dennis L. Taylor
*Assistant Examiner*—John A. Ricci
*Attorney, Agent, or Firm*—Cushman, Darby & Cushman

[57] ABSTRACT

An arcuate tunnel lining segment includes a precast concrete body that is divided into two angularly adjoining segment parts by a compressible strip which runs the length of the segment and throughout the thickness thereof. The segment parts are held fastened together through the strip by a plurality of connectors each having two laterally protruding ends which are embedded in the respective segment parts. The connectors are anchored in a way that permits the adjoining faces of the segment parts to move towards one another as the compressible strip becomes compressed in use.

7 Claims, 1 Drawing Sheet

ARCUATE PRECAST TUNNEL LINING SEGMENTS

BACKGROUND OF THE INVENTION

1. Field of the Invention

This invention relates to arcuate pre-cast concrete tunnel lining segments.

2. Background Prior Art

UK Patent Publications Nos. 2004931 and 2131514 disclose precast arcuate concrete tunnel lining segments having end faces which are spaced apart by compressible packing pieces and which are secured together in compression by locking devices. The compressible packing pieces allow a very limited movement of the end faces towards one another when the ring of segments so formed is subjected to very high loading in the ground in which the tunnel lining is laid giving some relief from stress on the segments. The relief which can be provided by this means is however totally inadequate in situations where the segments are subjected to very high loadings for example in very deep tunnels in mines and particularly where the ground or rocks through which the tunnel passes is unstable.

SUMMARY OF THE INVENTION

This invention provides an arcuate pre-cast concrete tunnel lining segment having at least one compressible insert extending through the thickness of the segment between opposing circumferential edges thereof and connecting means holding the segment portions on either side of the insert in alignment and against separation whilst permitting the segment portions to move together collapsing the insert when subjected to an excess external load.

For example the connection means may comprise a plurality of bolts cast in the segment portions on either side of the insert and extending through the insert, the bolts being anchored in the segment portions to hold the portions together in alignment to prevent extraction from the portions but permit the portions to move together collapsing the insert.

More particularly at least one end of each bolt may be formed with a head which engages in a socket in a portion of the segment, the socket having an abutment behind which the head on the bolt is trapped to prevent extraction of the bolt from the segment portion whilst permitting the bolt to extend further into the socket to allow the segment portions to move together with subject to an excess load.

The bolt may extend through a sleeve cast in the segment between the compressible insert and the socket with washer cast in the segment at either end of the sleeve to allow the bolt to move further into the segment when excess load is applied to the segment to cause the compressible insert to collapse.

Preferably the socket is held in place in the segment portion by one or more reinforcement elements cast in the segment portion and engaging the socket.

The other end of the bolt may extend into the other segment portion through a sleeve cast in the segment portion with a washer at the end of the sleeve adjacent the compressible insert and a washer and nut located on the bolt at the other end of the sleeve to anchor the bolt in the segment portion.

In any of the above arrangements the said bolts may be spaced along the insert with certain bolts disclosed towards the external surface of the segment and other bolts disposed towards the internal surface of the segment.

Also in any of the above arrangements the compressible insert may be formed from a strip of wood.

Further the insert may be formed with a plurality of spaced apertures or projections disposed away from the connecting means to minimise tensile stress on the faces of the segment portions when the insert is subjected to excess compressive force.

A plurality of such compressible inserts may be disposed at spaced locations around the circumferential length of the segment.

DESCRIPTION OF THE PREFERRED EMBODIMENT

Figure 1:
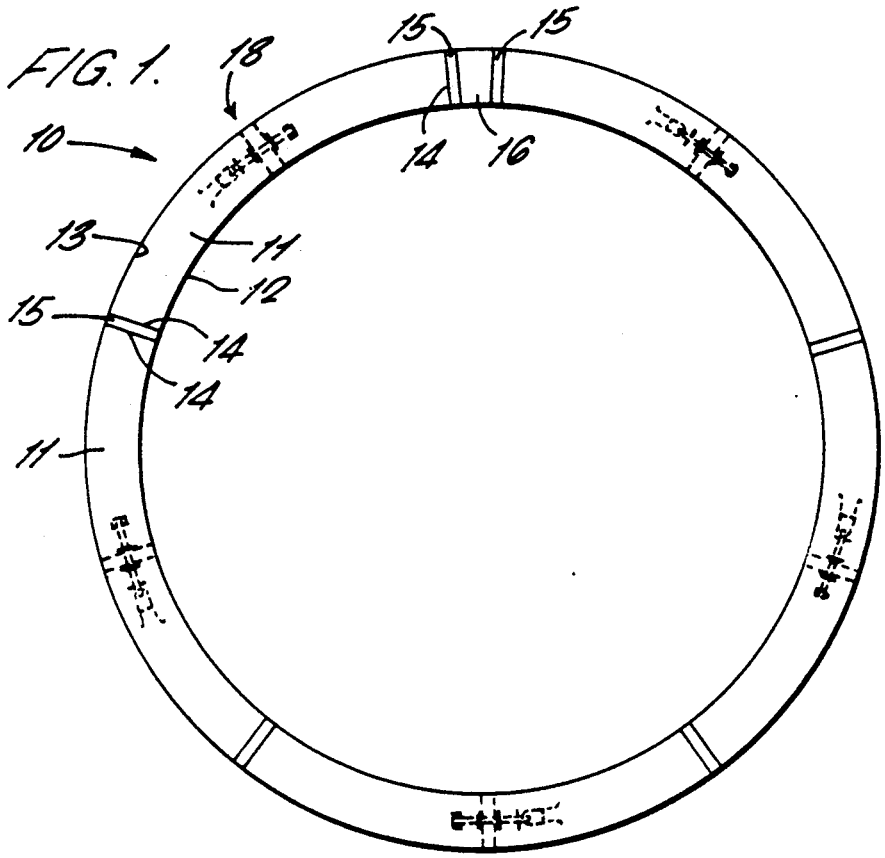
FIG. 1 is an elevation view of a ring of tunnel lining segments according to the invention.

Referring firstly to FIG. 1 of the drawings, there is shown a ring 10 of precast arcuate concrete tunnel lining segments 11 having radially inner and radially outer arcuate faces 12 and 13, respectively, and two angularly (i.e., circumferentially) opposite, radially and axially extending end faces 14. Each segment also has two axially opposite, angularly (i.e., circumferentially) and radially extending end faces. Adjacent angularly opposite end faces 14 of adjacent segments 11 may be spaced apart by a respective compressible packing piece 15 and the segment ends are secured together through the packing pieces (where provided) by locking arrangements such as disclosed in our U.K. Patent Publication Nos. 2004931 and 2131514. The compressible packing pieces 15 allow a very limited movement of the end faces 14 towards one another when the ring of segments is subjected to very high loading in the ground in which the tunnel lining is laid to relieve stress on the segments. Such very high loadings occur, for example in very deep tunnels in mines particularly where the ground or rock through the tunnel passes is unstable.

The ring of segments 10 is completed by a key 16 at the top of the ring which is spaced at its angularly opposite ends by two respective packing pieces 15 from the adjacent segment ends 14.

Figure 2:
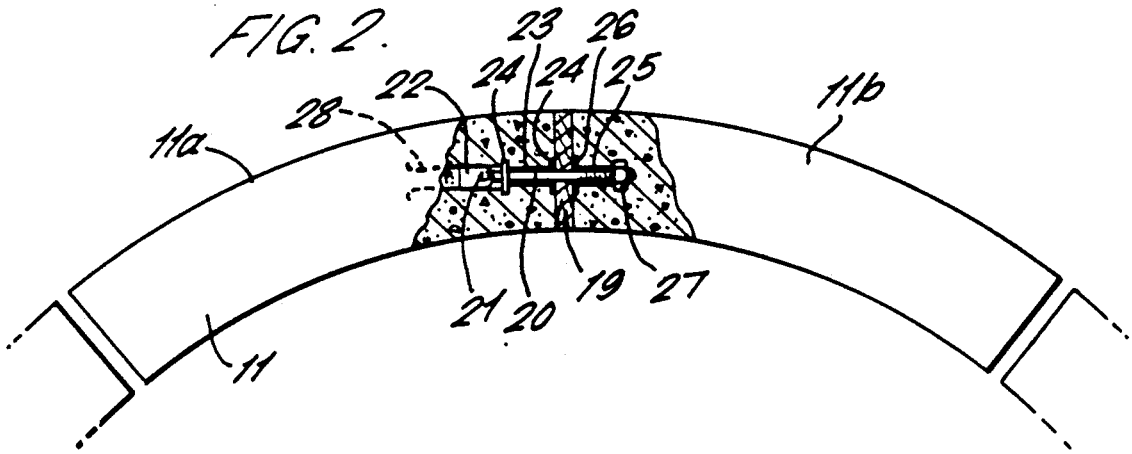
FIG. 2 is a detailed view of a compression joint provided in each segment.

In accordance with the present invention each precast concrete segment is formed with at least one "cast in" compressible joint 18 which will now be described with reference to FIG. 2 of the drawings.

The joint comprises a packing in the form of a strip 19 of a compressible wood or other compressible material such as a polymeric material dimensioned to extend over the full thickness (i.e., through the full radial extent) of the segment and for the full axial length of the segment. Four T-headed bolts 20 extend through the strip at spaced locations along the length thereof to project on either side of the strip. The part of each bolt 20 projecting to one side of the strip is formed with a T-shaped head 21 which engages in a moulded plastics socket 22 shaped to receive and retain the head of the bolt.

The construction of the socket is described and illustrated in our U.K. Patent Publication Nos. 2139268, 2139278 and 2139277. The bolt is encircled by a sleeve 23 between the insert (i.e., packing strip) 19 and socket 22 with a first round washer 24 at the socket end of the same sleeve of each sleeve and a second round washer 24 at the insert end. The part of the bolt projecting on the other side of the insert 19 also extends through a sleeve 25 with a square shaped washer 26 disposed between the sleeve 25 and insert 19. The bolt 20 projects from the sleeve 25 to receive a washer and nut 27 screwed onto the bolt. Each assembly of an insert 19 with its four bolts is cast in the respective arcuate concrete segment 11 so that the concrete of the segment is separated into two portions 11*a* and 11*b* disposed to either side of the insert. Each socket 22 is provided with reinforcement hoops 28 on either side which are cast into the respective segment portion 11*a* to anchor the socket firmly in the segment.

The arrangement provides a limited compression joint between the segment portions 11*a* and 11*b* which can collapse when the segment is subjected to excessive external loading as described above. In so doing, the end faces of the segment portions 11*a* and 11*b* on either side of the insert 19 move together, until the wood insert between the end faces cannot be further compressed. The bolts which normally hold the segment portions 11*a* and 11*b* in alignment and against separation accommodate the movement of the segment portions of towards on another by movement through the sleeve 23 into the sockets 22. The sockets 22 are designed to allow a limited movement of the T-shaped heads 21 of the bolts towards the bottoms of the sockets to cater for the movement.

It will be appreciated that modifications may be made to the above described embodiment without departing from the scope of the invention. For example, a plurality of such compressible inserts 18 may be provided in the circumferential extent of each segment. Furthermore, the form of connection between the adjacent segment portions 11*a* and 11*b* of each segment may employ other forms of connecting means such as the segment connectors described and illustrated in U.K. Patent Publication No. 2133852.

The inserts 19 may be formed with a plurality of additional apertures or projections at locations spaced from the ones through which by the bolts 20 pass through the inserts, to limit in position of, tensile stress on the end faces of the segment portions when the latter are subjected to compressive stress.

The following is the sequence of construction of a tunnel-lining segment in accordance with the invention:

The casting of each of the segments is carried out under factory-controlled conditions as follows:

(a) There are four connecting devices in a segment one meter wide. Two of these are extrados and two are near the intrados.

(b) A compressible packing is fitted in the mould effectively dividing the mould into two halves along its cord length.

(c) The packing is drilled in four places to accommodate the T-headed connecting bolts.

(d) A plate washer is placed over the T-bolt adjacent the T-head.

(e) A loose approximately half length sleeve is passed over each T-bolt near to the T-head thereof.

(f) A round washer is placed on the T-bolt adjacent the end of the sleeve.

(g) The T-box or socket is then fitted with two heavy duty wire reinforcement loops.

(h) The head of the T-bolt is engaged in the T-box.

(i) The bolt is then passed through the hole in the packing so that the round washer is now adjacent the packing.

(j) Another round washer is placed on the T-bolt on the other side of the packing.

(k) A further sleeve is placed over the remaining length of the bolt allowing for a plate washer and nut to be placed and tightened on the T-bolt. Three further bolts are assembled on the packing in a similar manner.

(l) When the nuts are firmly tightened on the bolts, a concrete tunnel lining segment is cast in the mould on either side of the insert. When the concrete has set (hardened) the resulting segment is moved from the mould and the T-bolt/packing assembly provides a strong enough inter-connection between the portions of the segment on either side of the packing to enable the segment to be handled and directed.

(m) When ground loadings are imposed, the packing may compress to only 40%, or so, of its thickness. The T-bolt connections in the sockets allow this to happen as described above, by the T-head bolts moving into the recesses of the T-boxes.

(n) The T-bolts will always remain effective as an aid to prevent radial joint movement.

The benefits of the system are as follows:

(1) By keeping the number of full segments in a ring to a minimun, the rings are easier to cast, handled, store and build.

(2) by increasing the numbers of compressible closure joints as compared with the joints provided between the segments themselves, closure takes place more freely and this is especially true in conditions where uneven ground pressures may exist.

(3) By incorporating sub-segments, reinforcement contour may be substantially reduced through reducing bending moments and or handling stresses.

(4) by using perforated compressible packing, tension stresses on the faces of the portions of the segments on either side of the packings are kept to a minimum when closure force is applied.

(5) By using the disclosed system of sub-segment jointing, the bolts always act as a mechanical longitudinal joint fixing in the form of factory positioned dowels and help arrest any possible radial movement.

(6) The arrangement can be used in connection with the segment-fixing arrangement described and illustrated in U.K. Patent No. 2004931 which enables accurate building of longitudinal joints, and the loops fixings prevent radial joint movement between four segments.

I claim:

1. An arcuate tunnel-lining segment having two angularly spaced, longitudinally and radially extending opposite first ends, two axially spaced, angularly and radially extending opposite second ends, and radially spaced inner and outer surfaces bounded by said ends, said segment comprising:

a body of precast concrete bounded by said ends and said surfaces;

an axially extending packing strip of laterally compressible material, said strip being embedded in said body of precast concrete so as to extend axially of said body from one of said second ends to the other of said second ends at a location which is intermediate said first ends; said strip also extending radially from said outer surface to said inner surface, thereby dividing said body into two angularly adjoining segment parts separated from one another by said strip and having corresponding faces engaging said strip;

a plurality of connecting means each having a central portion penetrating laterally through said strip, and two opposite end portions embedded in said body; said connecting means thereby holding said segment parts together with said faces thereof in confronting alignment with one another against laterally opposite faces of said strip while permitting movement of said faces of said segment parts towards one another by permanent deformation of said strip in compression when said tunnel lining segment is subjected in use to excessive external compressive loading.

2. The arcuate tunnel-lining segment of claim 1, wherein:

said connecting means comprise a respective plurality of bolts, each having a head provided on one end portion thereof and a nut provided on the other end portion thereof.

3. The arcuate tunnel-lining segment of claim 2, wherein:

each said connecting means further includes a socket embedded in the same segment part as the respective bolt head; said socket having an abutment behind which the respective bolt head is trapped for preventing extraction of the bolt from the respective segment part while permitting the respective bolt to extend further away from the strip in the socket, for coordinating movement of the segment parts towards one another as said strip is permanently deformed in compression.

4. The arcuate tunnel-lining segment of claim 3, wherein:

each said connecting means further comprises a first sleeve cast in the same segment part as the respective said bolt head; said first sleeve circumferentially surrounding a first shank portion of said bolt; and further including a first washer surrounding said first shank portion and abutting between a respective face of said strip and an end of said first sleeve and a second washer surrounding said first shank portion and axially abutting between said socket and an opposite end of said first sleeve.

5. The arcuate tunnel-lining segment of claim 4, wherein:

each said connecting means further comprises a second sleeve cast in the same segment part as the respective said nut; said second sleeve circumferentially surrounding a second shank portion of said bolt; and further including a first washer surrounding said second shank portion and abutting between a respective face of said strip and an end of said second sleeve and a second washer surrounding said second shank portion and axially abutting between said nut and an opposite end of said second sleeve.

6. The arcuate tunnel-lining segment of claim 3, wherein:

each said connecting means further comprises a reinforcing element embedded in the same segment part as said sockets and engaging a respective said socket for holding said socket in place.

7. The arcuate tunnel-lining segment of claim 2, wherein:

said strip is made of wood.

* * * * *